US006726045B1

(12) United States Patent
Chen et al.

(10) Patent No.: US 6,726,045 B1
(45) Date of Patent: Apr. 27, 2004

(54) INTERLOCKING STRUCTURE

(76) Inventors: Kenneth Yimin Chen, 19968 Skyline Dr., Walnut, CA (US) 91789; Yi C. Chen, 19968 Skyline Dr., Walnut, CA (US) 91789

( * ) Notice: Subject to any disclaimer, the term of this patent is extended or adjusted under 35 U.S.C. 154(b) by 0 days.

(21) Appl. No.: 10/372,700

(22) Filed: Feb. 21, 2003

(51) Int. Cl.[7] ..... B65D 7/24
(52) U.S. Cl. ..... 220/4.34; 220/4.33; 220/485
(58) Field of Search ..... 220/4.34, 4.33, 220/485

(56) References Cited

U.S. PATENT DOCUMENTS 2,501,980 A * 3/1950 Hix ..... 220/4.33
3,917,103 A 11/1975 Beretta
4,015,743 A 4/1977 Beretta
4,629,086 A 12/1986 Trubiano
5,096,080 A * 3/1992 Penny ..... 220/4.09
5,101,995 A 4/1992 Trubiano
5,191,989 A * 3/1993 Butler ..... 220/4.34
6,216,872 B1 * 4/2001 Haasbroek ..... 206/512
6,401,950 B1 6/2002 Chiang
6,601,723 B1 * 8/2003 Ziglar ..... 220/4.34

* cited by examiner

*Primary Examiner*—Joseph Man-Fu Moy
(74) *Attorney, Agent, or Firm*—Chan Law Group LC

(57) ABSTRACT

The invention is an interlocking structure. It can be shipped in a low volume disassembled state. It is easily interlocked together, without tools or special skills, by the eventual user. The interlocked structure has uncommon rigidity and strength. Containers like dresser drawers, laundry baskets or waste paper baskets, shelters like dog houses and human shelters, or furniture like a portable fireplace can be interlocked together using a plurality of interconnecting rods and hooks. The abstract is submitted with the understanding that it will not be used to interpret or limit the scope or meaning of the claims. 37 CFR 1.72(b).

19 Claims, 11 Drawing Sheets

INTERLOCKING STRUCTURE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

FIELD OF INVENTION

The present invention relates generally to the field of structures and more particularly to easily disassembled, interlocking structures.

BACKGROUND OF THE INVENTION

The great majority of structures, containers and furniture are interlocked from component parts that are permanently affixed to each other. It was thought that permanent assembly resulted in greater strength and rigidity than containers or furniture capable of disassembly. Generally, manufacturing costs of permanently assembled structures, containers and furniture are less than structures, containers or furniture capable of disassembly. Often, these permanently interlocked structures, containers and furniture are designed for easy assembly by unskilled, inexpensive labor. It is well known in the art to use attachments such as glue, nails, screws, angled metal braces, and the like to permanently affix structures, containers and furniture together.

The permanently assembled structures, containers and furniture are shipped in their assembled to state directly to retailers. These assembled articles takes up a great deal of volume resulting in higher shipping costs. In a collapsed or flattened state, the structures, containers or furniture take up much less volume significantly reducing shipping costs. There are some drawbacks to the collapsible structures, container or furniture such as inferior quality, strength and durability. Another drawback is that the end user assumes the burden of assembly. This usually requires the assembler to possess the necessary tools and the wherewithal to use them to properly assemble the structure.

The prior art lacks a container or furniture shipped in a low volume disassembled state that the eventual user can easily assemble into a sturdy and structure without tools or special skills. The present invention satisfies these requirements, as well as others.

BRIEF SUMMARY OF THE INVENTION

The invention resides in an interlocking structure. It can be shipped in a low volume disassembled state. It is easily interlocked together, without tools or special skills, by the eventual user. The interlocked structure has uncommon rigidity and strength. Containers like dresser drawers, laundry baskets or waste paper baskets, shelters like dog houses and human shelters, or furniture like a portable fireplace can be interlocked together using a plurality of interconnecting rods and hooks The easily assembled interlocking structure includes at least one rod. The rod has a U-shape with a first end and a second end. The interlocking structure has at least four sides and a bottom. The four sides include a right side, a left side, a front side and a back-side. Each side has four edges. The bottom also has four edges. To connect the four sides together, removeably interlock the edge of each side to the edge of the adjacent side. The bottom side removeably interlocks to at least two of the interlocked sides. A side and the opposite side each have at least one rod receptacle. The interlocking structure of four sides and the bottom is held together by the removeable installation of the first end of the rod into the rod receptacle on the side and the second end of the rod into a rod receptacle on the opposite side.

A variant of this invention is used to construct a waste paper basket and a drawer. All five sides are planar.

The right side has an outwardly cantilevered, hooked-rod extending from its lower front and lower rear corners. It also has a straight-rod-receiving hole in its upper front and upper rear corners.

The left side has an outwardly cantilevered, hooked-rod extending from the lower front and lower rear corners. The left side also has a straight-rod-receiving hole in the upper front and upper rear corners.

The front side has an outwardly cantilevered straight-rod extending from the upper right and upper left corners. Each straight-rod extends outwardly normal to the plane of the front side. The front side has at least one U-shaped rod-receiving hole located along its upper edge. Each U-shaped rod-receiving hole is coplanar to the front side. The front side has at least one straight-rod-receiving hole located along its lower edge. Each straight-rod-receiving hole is normal to the plane of the front side. The front side has a hooked-rod receiver in its lower right and lower left corners.

The back-side has an outwardly cantilevered, straight-rod extending from its upper right and upper left corners. Each straight-rod extends normal to the plane of the back-side. The back-side has at least one U-shaped rod-receiving hole located along its upper edge. Each U-shaped rod-receiving hole is coplanar to the back-side. The back-side has at least one straight-rod-receiving hole located along its lower edge. Each straight-rod-receiving hole is normal to the plane of the back-side. The back-side has a hooked-rod receiver located in the lower right and lower left corners.

The bottom has at least one cantilevered rod extending forward from the front edge. It also has at least one cantilevered rod extending backward from the back edge. Each cantilevered rod is coplanar to the bottom.

The at least one cantilevered rod extending forward from the bottom is slideably connected into the at least one straight-rod-receiving hole located along the lower edge of the front side. The at least one cantilevered rod extending backward from the bottom is slideably connected into the at least one straight-rod-receiving hole located along the lower edge of the back-side.

The hooked-rod of the right side is hook-ably connected to the hooked-rod receiver of the front side. The hooked-rod of the right side is hook-ably connected to the hooked-rod receiver of the back-side. The cantilevered straight-rod of the front side is slideably connected into the straight-rod-receiving hole of the right side. The cantilevered straight-rod of the back-side is slideably connected into the straight-rod-receiving hole of the right side.

The hooked-rod of the left side is hook-ably connected to the hooked-rod receiver of the front side. The hooked-rod of the left side is hook-ably connected to the hooked-rod receiver of the back-side. The cantilevered straight-rod of the front side is slideably connected into the straight-rod-receiving hole of the left side. The cantilevered straight-rod of the back-side is slideably connected into the straight-rod-receiving hole of the left side.

The rod is slideably connected into the rod-receiving hole of the front side and the rod-receiving hole of the back-side.

In a variant of this invention, each hooked-rod receiver of the front side has a notch and an upright rod receiver hole and each the hooked-rod receiver of the back-side has a notch and an upright rod receiver hole.

In another variant of this invention, each hooked-rod of the right side and the left side has a horizontal portion and an upright portion and are located within the plane of that side.

A variant of this invention is used to construct a laundry basket. The front side has a cantilevered, upwardly hooked-rod extending substantially perpendicularly rearward from its lower right and lower left corners. The hooked-rod has a horizontal section supporting a vertical section. The front side has a cantilevered, horizontal straight-rod extending substantially perpendicularly rearward from its upper right and upper left corners. The front side has at least one rod-receiving hole located along its upper edge. Each rod-receiving hole is vertically aligned and coplanar to the front side. The front side has at least one straight-rod-receiving hole located along its lower edge. Each straight-rod-receiving hole is normal to the plane of the front side. The front side is planar.

The back-side has a cantilevered, upwardly hooked-rod extending substantially perpendicularly forward from its lower right and lower left corners. The hooked-rod has a horizontal section supporting a vertical section. The back-side has a cantilevered, horizontal straight-rod extending substantially perpendicularly forward from its upper right and upper left corners. The back-side has at least one rod-receiving hole located along its upper edge. Each rod-receiving hole is vertically aligned and coplanar to the back-side. The back-side has at least one straight-rod-receiving hole located along its lower edge. Each straight-rod-receiving hole is normal to the plane of the back-side. The back-side is planar.

The right side has a hooked-rod receiver vertically aligned in its lower front and lower rear corners. The hooked-rod receiver has a rounded notch edge to accept the horizontal portion of the hooked-rod. The right side has a horizontal straight-rodreceiving hole in its upper front and upper rear corners. The right side is planar. Each hooked-rod receiver and horizontal straight-rod-receiving hole lay within the plane of the right side.

The left side has a hooked-rod receiver vertically aligned in its lower front and lower rear corners. The hooked-rod receiver has a rounded notch edge to accept the horizontal portion of the hooked-rod. The left side has a horizontal straight-rod-receiving hole in its upper front and upper rear corners. The left side is planar. Each hooked-rod receiver and horizontal straight-rod-receiving hole lay within the plane of the left side.

The bottom has at least one cantilevered rod extending forward and substantially perpendicular to its front edge. The bottom has at least one cantilevered rod extending backward and substantially perpendicular to its back edge. The bottom is planar. Each cantilevered rod lays within the plane of the bottom.

Each of the bottom's forward extending cantilevered rods are slideably connected into each straight-rod-receiving hole located along the lower edge of the front side. Likewise, each of the bottom's backward extending cantilevered rods are slideably connected into each straight-rod-receiving hole located along the lower edge of the back-side.

The hooked-rod of the front side is hook-ably connected to the hooked-rod receiver of the right side. The hooked-rod of the back-side is hook-ably connected to the hooked-rod receiver of the right side. The cantilevered horizontal straight-rod of the front side is slideably connected into the horizontal straight-rod-receiving hole of the right side. The cantilevered straight-rod of the back-side is slideably connected into the horizontal straight-rod-receiving hole of the right side.

The hooked-rod of the front side is hook-ably connected to the hooked-rod receiver of the left side. The hooked-rod of the back-side is hook-ably connected to the hooked-rod receiver of the left side. The horizontal cantilevered straight-rod of the front side is slideably connected into the horizontal straight-rod-receiving hole of the left side. The cantilevered horizontal straight-rod of the back-side is slideably connected into the horizontal straight-rod-receiving hole of the left side.

Each rod is slideably connected into the rod-receiving hole of the front side and the rod-receiving hole of the back-side.

In still another variation of this invention, a lid is interlocked by a hinge means to the upper edge of the back-side. The hinge means comprises a pair of outwardly cantilevered, hooked-rods. The hooked-rods are aligned in opposite directions towards each other on the lower edge of the lid. The lid and the hooked-rods are coplanar. A pair of hooked-rod, receiving tubes are horizontally located on the upper edge of the back-side. The hooked-rods are slideably connected into the hooked-rod-receiving tubes.

In yet another variant of this invention, the right side, the left side, the front side, the back-side and the bottom are fabricated from metal wire, whicker stretched over a metal wire frame, plastic, wood with plastic cantilevered rods or wood with metal cantilevered rods.

Another variant of this invention is used to construct a portable fireplace. The four sides are interlocked together by a first frame and a second frame. The four include a first side, a second side, a third side and a fourth side. Each side has a first substantially vertical edge and a second substantially vertical edge. The size and shape of the first frame and the second frame facilitates its removeable interlocking with each adjacent side and removeable interlocking to the bottom.

The first frame has a first substantially vertical support linked by at least one cross member to a second substantially vertical support. The second frame has a first substantially vertical support linked by at least one cross member to a second substantially vertical support. Each substantially vertical support has a first end, a second end, a front face, a back face and an inner face.

The bottom includes a plate removeably interlocked to a base. The plate serves as an ash and flame shield. The first frame and the second frame are removeably interlocked into the plate. The base has a plurality of legs.

The second side and the fourth side each have a first and a second horizontal, coplanar rod cantilevered outward from each substantially vertical edge. The first frame and the second frame have a pair of horizontal rod-receiving holes on the back face of each substantially vertical support. Each horizontal rod-receiving hole is substantially perpendicular to the plane of each frame. The second side is interlocked to the first substantially vertical support of the first frame and the second frame so that each first and second horizontal coplanar rod is installed into the corresponding pair of horizontal rod-receiving holes in each first substantially vertical support. The fourth side is interlocked to the second substantially vertical support of the first frame and the second frame so that each first and second horizontal coplanar rod is installed into the corresponding pair of horizontal rod-receiving holes in each second substantially vertical support.

A grill is placed upon the plate. The first end of each substantially vertical support has a flap. The plate has four slots sized, shaped and located to slideably receive the flap of each substantially vertical support.

A side is releasably interlocking into the first frame by a hinge means. The hinge means comprises a pair of outwardly cantilevered, hooked-rods extending downwards from the first substantially vertical edge of the first side and a pair of hooked rod-receiving tubes vertically located on the front face of the substantially vertical support.

The second frame has a means for releasably interlocking with the third side. Each substantially vertical support has at least one pivoting locking plate. The pivoting locking plate pivots on a rotation point. The third side is retained when the first substantially vertical edge is located against a cross member and the second substantially vertical edge is located against a cross member and each locking plate is pivoted into a horizontal position.

A fireplace lid is installed by interlocking it with the second end of each substantially vertical support.

The foregoing has outlined the more pertinent and important features of the present invention in order that the detailed description of the invention that follows may be better understood so the present contributions to the art may be more fully appreciated. Additional features of the present invention will be described hereinafter, which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

The invention will be more fully understood by reference to the following drawings that are for illustrative purposes only.

DETAILED DESCRIPTION

Figure 1:
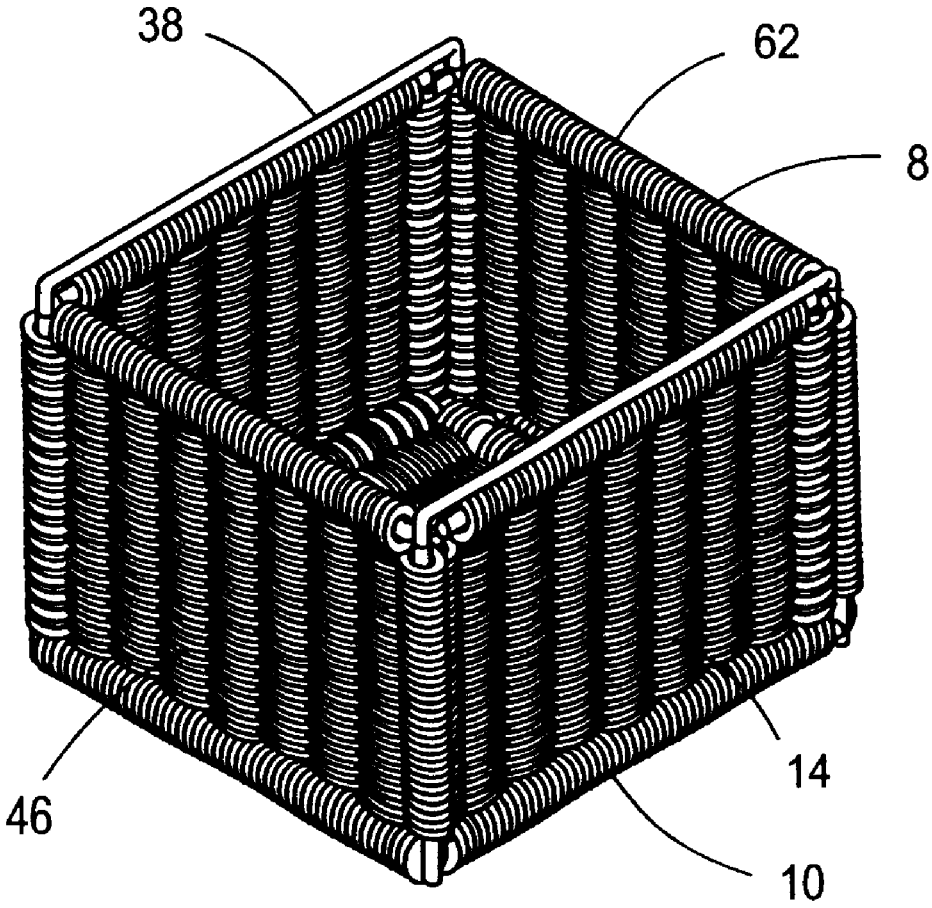
FIG. 1 is a perspective view of an interlocked drawer.
Figure 2:
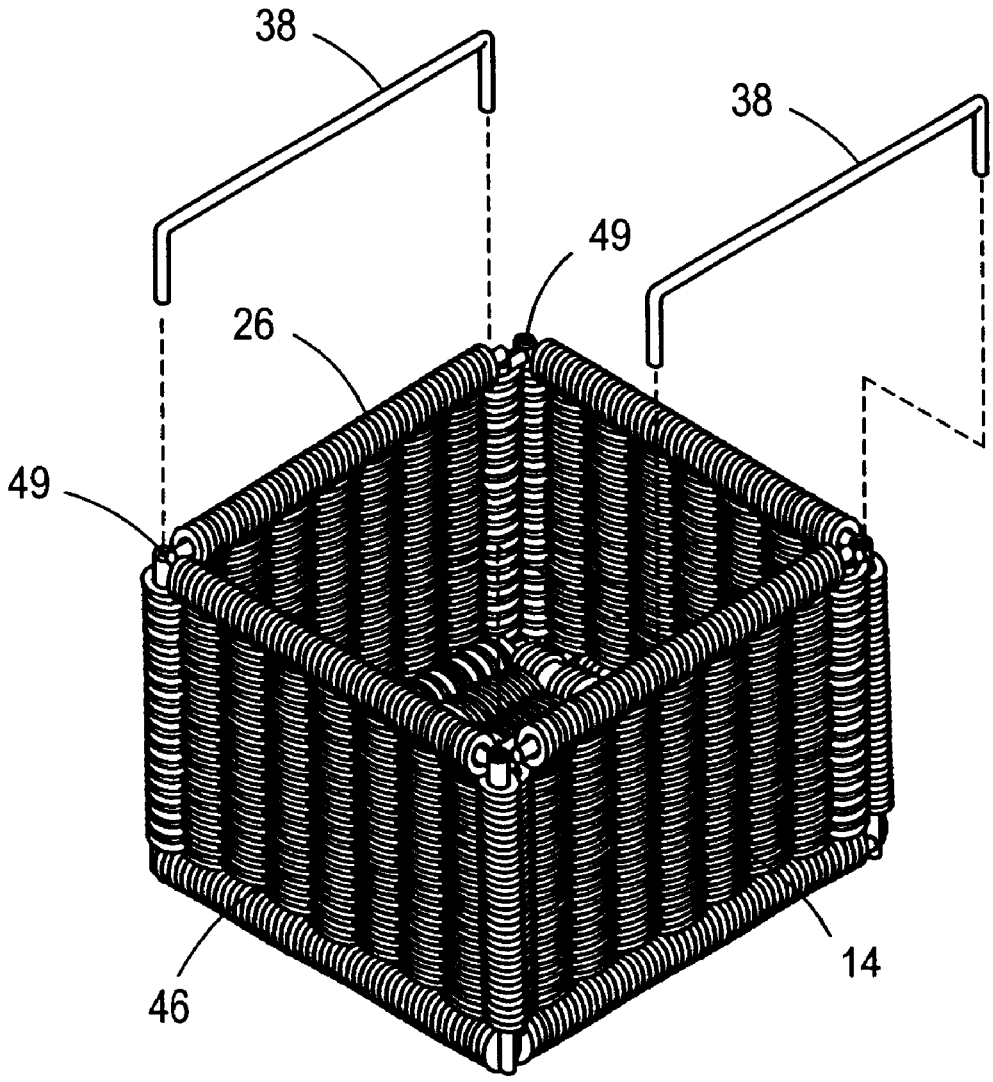
FIG. 2 is a perspective view of the drawer detailing the installation of the U-shaped rods.
Figure 3:
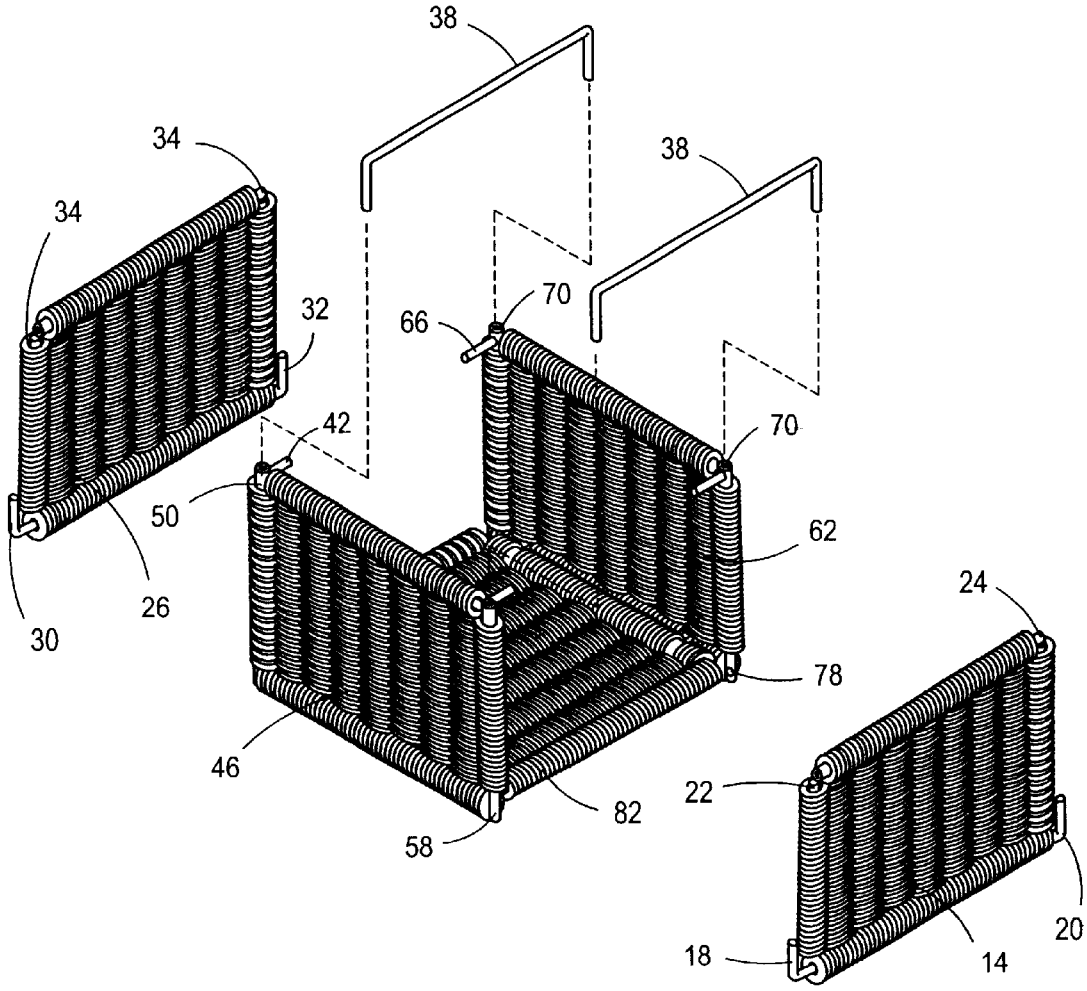
FIG. 3 is a partially exploded perspective view of the drawer showing the installation of the right and left sides.
Figure 4:
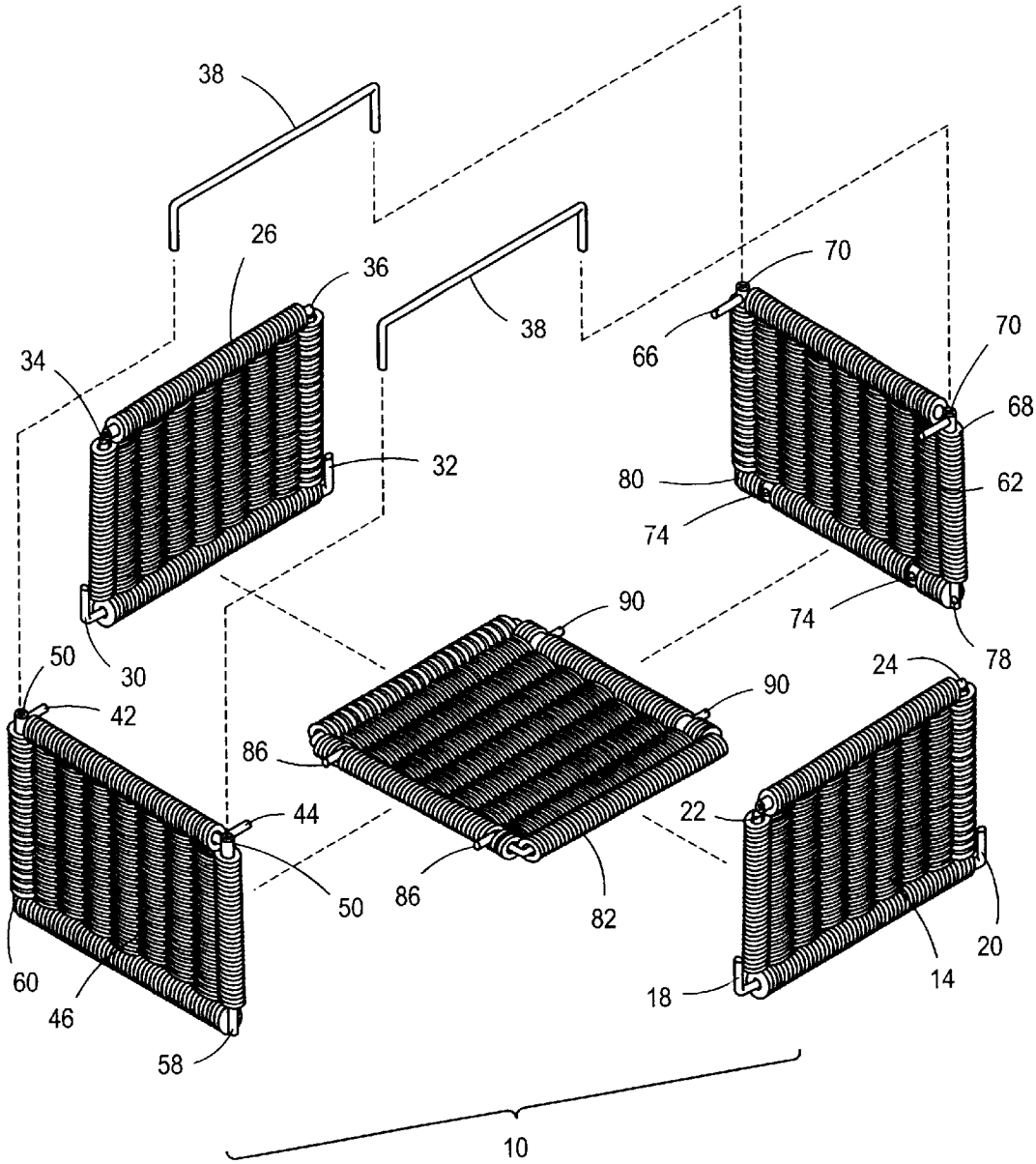
FIG. 4 is an exploded perspective view of the drawer.
Figure 5:
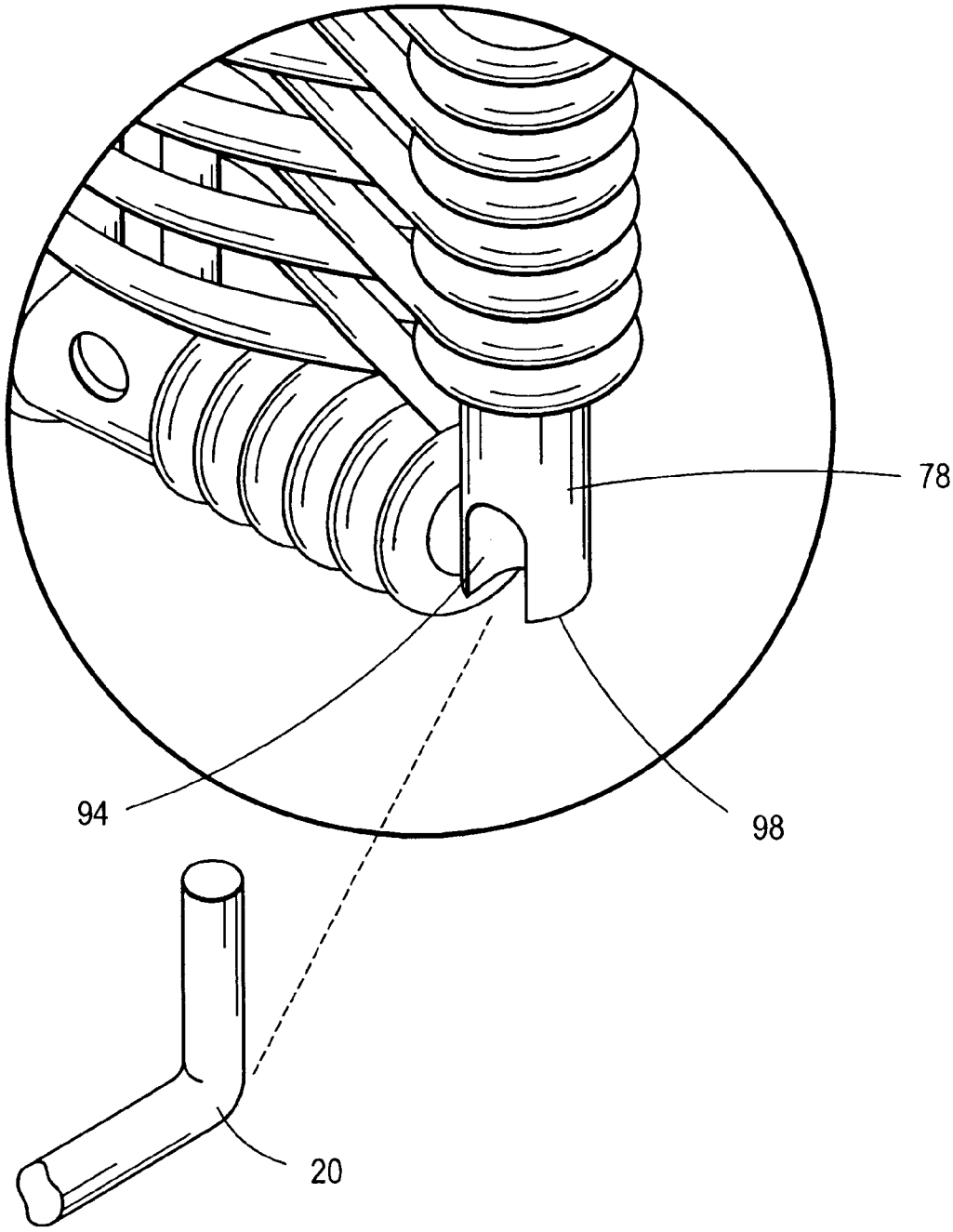
FIG. 5 is a close up view showing how the hooked-rod of the right side is hook-ably connected to the hooked-rod receiver of the back-side.

As shown in FIGS. 1–13, the easily assembled interlocking structure 8 includes at least one rod 38. The rod 38 has a U-shape with a first end 39 and a second end 40. The interlocking structure has at least four sides and a bottom 82. The four sides include a right side 14, a left side 26, a front side 46 and a back-side 62. Each side has four edges. The bottom 82 also has four edges. To connect the four sides together, removeably interlock the edge of each side to the edge of the adjacent side. The bottom side 82 removeably interlocks to at least two of the interlocked sides. A side and the opposite side each have at least one rod receptacle 49. The interlocking structure of four sides and the bottom 82 is held together by the removeable installation of the first end of the rod 38 into the rod receptacle 49 on the side and the second end of the rod 39 into a rod receptacle 49 on the opposite side.

A variant of this invention, shown in FIGS. 1–8, is used to construct an easily assembled, collapsible drawer 10 and an easily assembled, collapsible waste paper basket 8.

The waste paper basket 8 and the drawer 10 include a right side 14, a left side 26, a front side 46, a back-side 62 and a bottom 82. All five sides are planar.

The right side 14 has an outwardly cantilevered, hooked-rod 18 and 20 extending from its lower front and lower rear corners, respectively. It also has a straight-rod-receiving hole 22 and 24 in its upper front and upper rear corners, respectively.

The left side 26 has an outwardly cantilevered, hooked-rod 30 and 32 extending from the lower front and lower rear corners, respectively. The left side 26 also has a straight-rod-receiving hole 34 and 36 in the upper front and upper rear corners, respectively.

The front side 46 has an outwardly cantilevered straight-rod 42 and 44 extending from the upper right and upper left corners, respectively. Each straight-rod 42 and 44 extends outwardly normal to the plane of the front side. The front side 46 has at least one U-shaped rod-receiving hole 50 located along its upper edge. Each U-shaped rod-receiving hole 50 is coplanar to the front side 46. The front side 46 has at least one straight-rod-receiving hole 54 located along its lower edge. Each straight-rod-receiving hole 54 is normal to the plane of the front side 46. The front side 46 has a hooked-rod receiver 58 and 60 in its lower right and lower left corners, respectively.

The back-side 62 has an outwardly cantilevered, straight-rod 66 and 68 extending from its upper right and upper left corners, respectively. Each straight-rod 66 and 68 extends normal to the plane of the back-side 62. The back-side 62 has at least one U-shaped rod-receiving hole 70 located along its upper edge. Each U-shaped rod-receiving hole 70 is coplanar to the back-side 62. The back-side 62 has at least one straight-rod-receiving hole 74 located along its lower edge. Each straight-rod-receiving hole 74 is normal to the plane of the back-side 62. The back-side 62 has a hooked-rod receiver 78 and 80 located in the lower right and lower left corners, respectively.

The bottom 82 has at least one cantilevered rod 86 extending forward from the front edge. It also has at least one cantilevered rod 90 extending backward from the back edge. Each cantilevered rod 86 and 90 is coplanar to the bottom.

The at least one cantilevered rod 86 extending forward from the bottom 82 is slideably connected into the at least one straight-rod-receiving hole 54 located along the lower edge of the front side 46. The at least one cantilevered rod 90 extending backward from the bottom 82 is slideably connected into the at least one straight-rod-receiving hole 74 located along the lower edge of the back-side 62.

The hooked-rod 18 of the right side 14 is hook-ably connected to the hooked-rod receiver 58 of the front side 46. The hooked-rod 20 of the right side 14 is hook-ably connected to the hooked-rod receiver 78 of the back-side 62. The cantilevered straight-rod 42 of the front side 46 is slideably connected into the straight-rod-receiving hole 22 of the right side 14. The cantilevered straight-rod 66 of the back-side 62 is slideably connected into the straight-rod-receiving hole 24 of the right side 14.

The hooked-rod 30 of the left side 26 is hook-ably connected to the hooked-rod receiver 60 of the front side 46. The hooked-rod 32 of the left side 26 is hook-ably connected to the hooked-rod receiver 78 of the back-side 62. The cantilevered straight-rod 44 of the front side 46 is slideably connected into the straight-rod-receiving hole 34 of the left side 26. The cantilevered straight-rod 68 of the back-side 62 is slideably connected into the straight-rod-receiving hole 36 of the left side 26.

The rod 38 is slideably connected into the rod-receiving hole 50 of the front side 46 and the rod-receiving hole 70 of the back-side 62.

In a variant of this invention, each hooked-rod receiver 58 and 60 of the front side 46 has a notch and an upright rod receiver hole and each the hooked-rod receiver 78 and 80 of the back-side 62 has a notch 94 and an upright rod receiver hole 98.

In another variant of this invention, each hooked-rod 18, 20, 30 and 32 of the right side 14 and the left side 26, respectively, has a horizontal portion and an upright portion and are located within the plane of that side.

In yet another variant of this invention, the right side 14, the left side 26, the front side 46, the back-side 62 and the bottom 82 are fabricated from metal wire, whicker stretched over a metal wire frame, plastic, wood with plastic cantilevered rods or wood with metal cantilevered rods.

The rod is slideably connected into the rod-receiving hole of the front side and the rod-receiving hole of the back-side.

In a variant of this invention, each hooked-rod receiver of the front side has a notch and an upright rod receiver hole and each the hooked-rod receiver of the back-side has a notch and an upright rod receiver hole.

In another variant of this invention, each hooked-rod of the right side and the left side has a horizontal portion and an upright portion and are located within the plane of that side.

Figure 6:
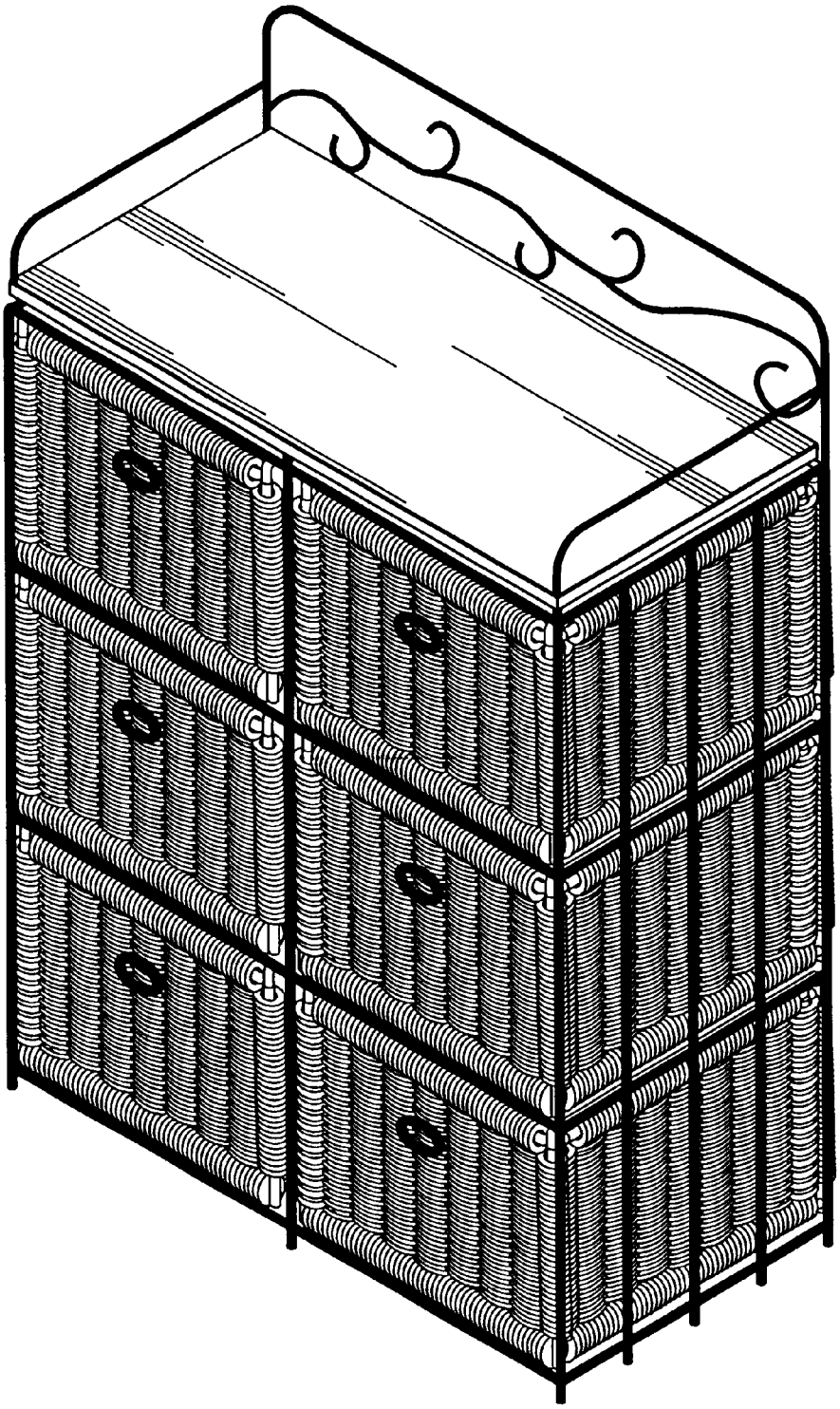
FIG. 6 is a perspective view showing several drawers arranged on a support frame to form a dresser.
Figure 7:
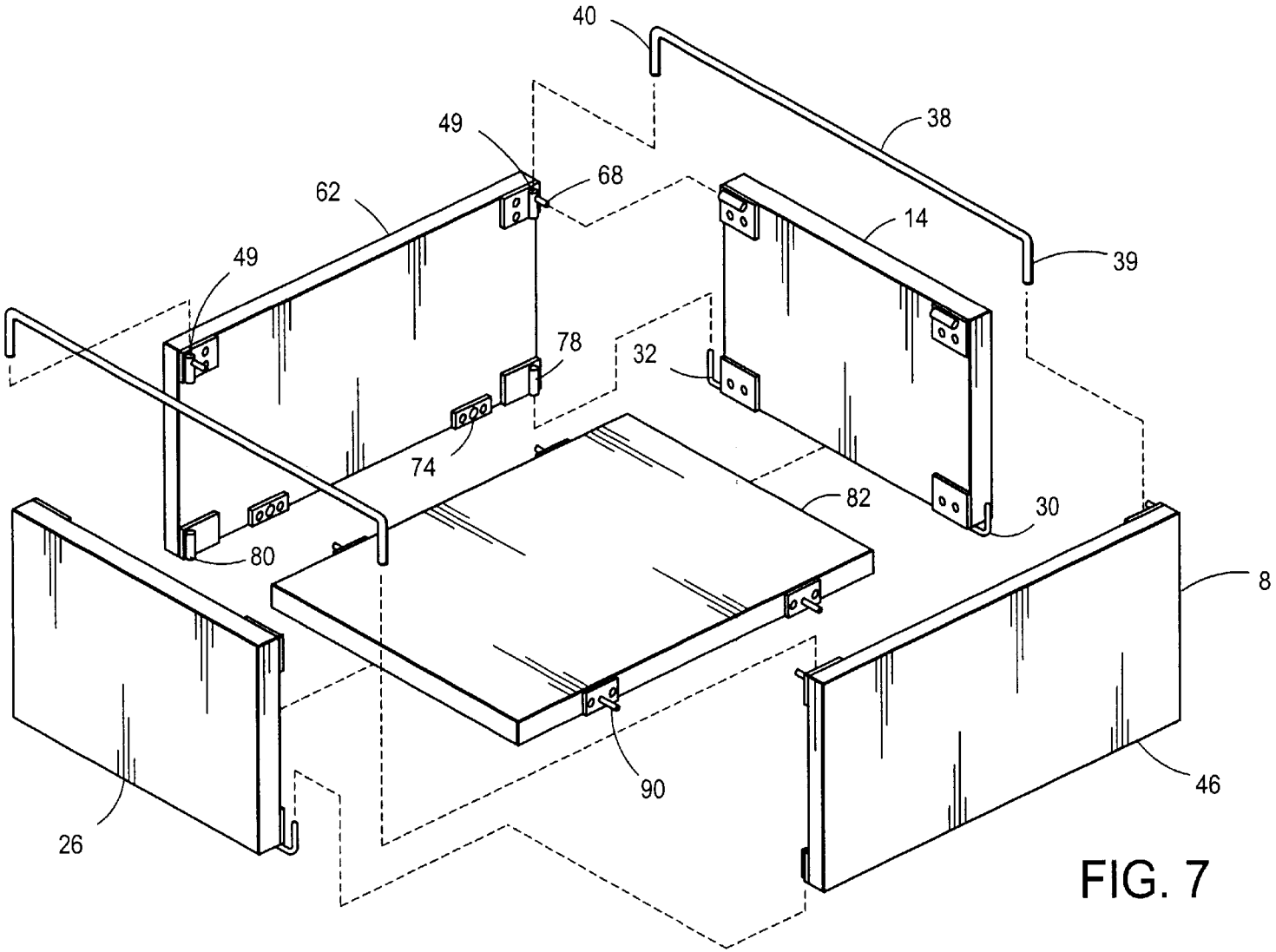
FIG. 7 is an exploded perspective view of the drawer made from wood.
Figure 8:
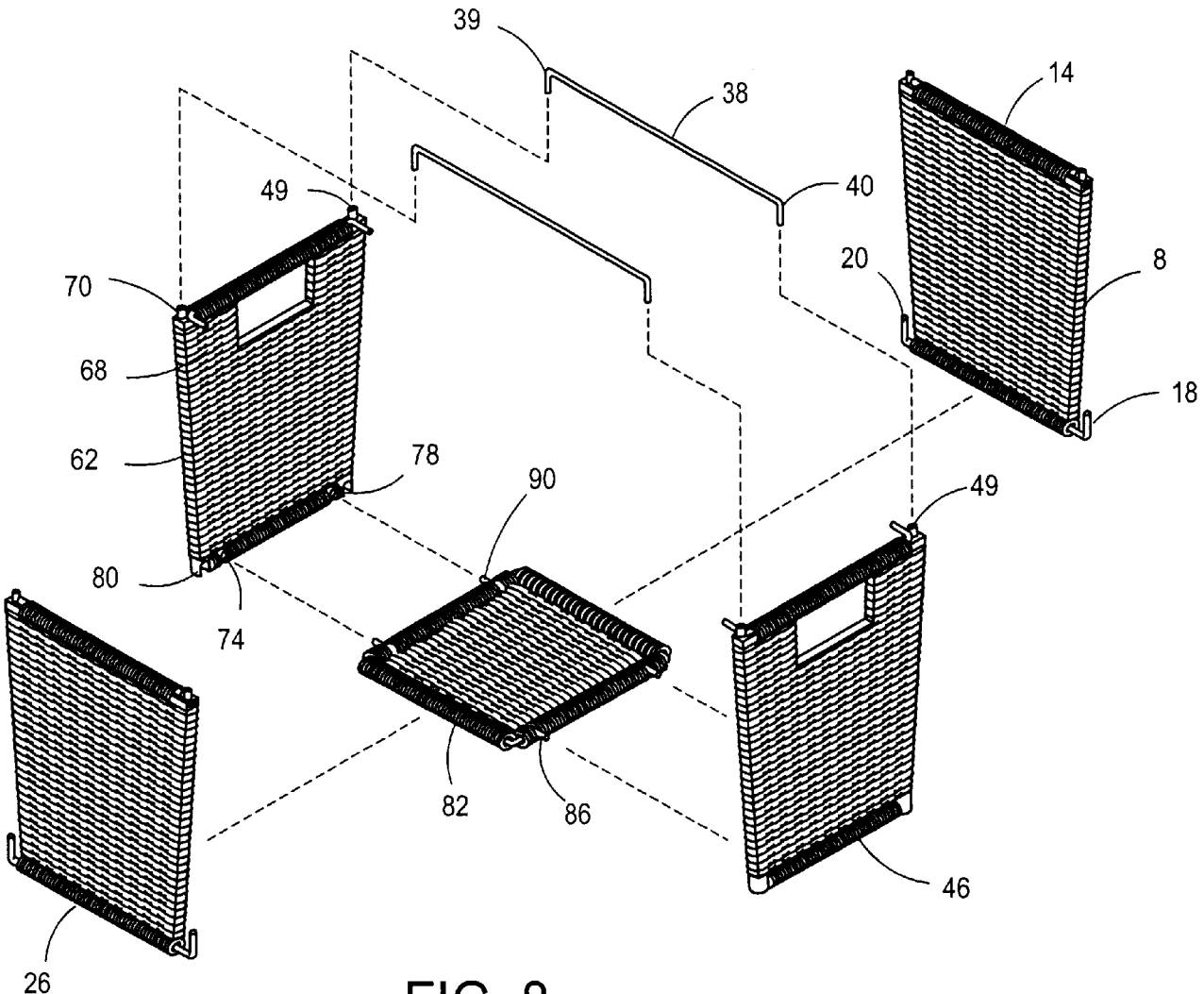
FIG. 8 is an exploded perspective view of the waste paper basket.

FIG. 6 shows a dresser made up of several drawers arranged on a support frame.

Figure 9:
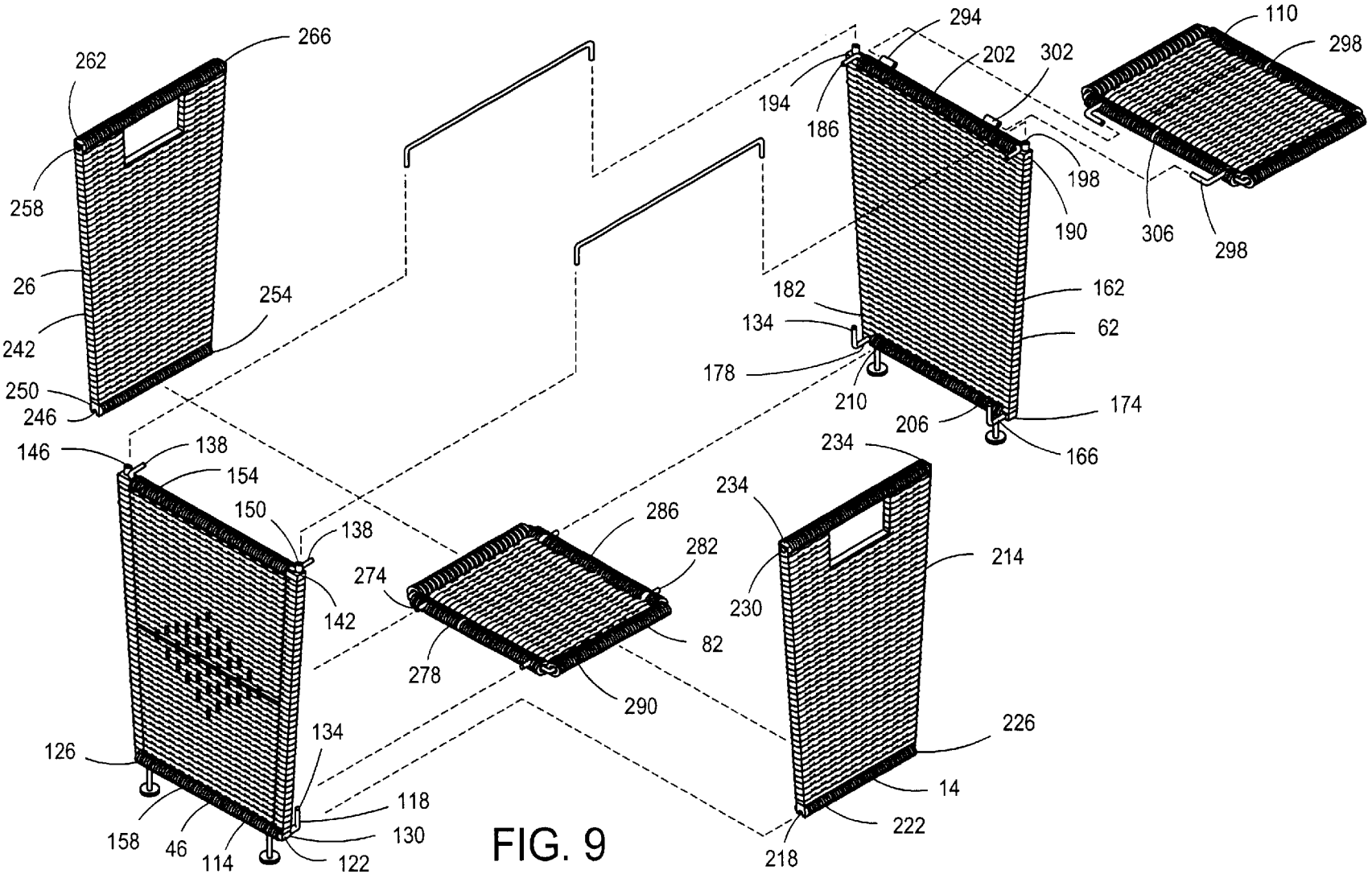
FIG. 9 is an exploded perspective view of the laundry basket.

As shown in FIG. 9, a variant of this invention is used to construct a laundry basket 110. The front side 114 has a cantilevered, upwardly hooked-rod 118 extending substantially perpendicularly rearward from its lower right 122 and lower left 126 corners. The hooked-rod 118 has a horizontal section 130 supporting a vertical section 134. The front side 114 has a cantilevered, horizontal straight-rod 138 extending substantially perpendicularly rearward from its upper right 142 and upper left corners 146. The front side 114 has at least one rod-receiving hole 150 located along its upper edge 154. Each rod-receiving hole 150 is vertically aligned and coplanar to the front side 114. The front side 114 has at least one straight-rod-receiving hole 154 located along its lower edge 150. Each straight-rod-receiving hole 154 is normal to the plane of the front side 114. The front side 114 is planar.

The back-side 162 has a cantilevered, upwardly hooked-rod 166 extending substantially perpendicularly forward from its lower right 170 and lower left 174 corners. The hooked-rod 166 has a horizontal section 178 supporting a vertical section 182. The back-side 162 has a cantilevered, horizontal straight-rod 186 extending substantially perpendicularly forward from its upper right 190 and upper left 194 corners. The back-side 162 has at least one rod-receiving hole 198 located along its upper edge 202. Each rod-receiving hole 198 is vertically aligned and coplanar to the back-side 162. The back-side 162 has at least one straight-rod-receiving hole 206 located along its lower edge 210. Each straight-rod-receiving hole 206 is normal to the plane of the back-side 162. The back-side 162 is planar.

The right side 214 has a hooked-rod receiver 218 vertically aligned in its lower front 222 and lower rear 226 corners. The hooked-rod receiver 218 has a rounded notch edge to accept the horizontal portion of the hooked-rod. The right side 214 has a horizontal straight-rod-receiving hole 230 in its upper front 234 and upper rear 238 corners. The right side 214 is planar. Each hooked-rod receiver 218 and horizontal straight-rod-receiving hole 230 lay within the plane of the right side 214.

The left side 242 has a hooked-rod receiver 246 vertically aligned in its lower front 250 and lower rear 254 corners. The hooked-rod receiver 246 has a rounded notch edge to accept the horizontal portion of the hooked-rod. The left side 242 has a horizontal straight-rod-receiving hole 258 in its upper front 262 and upper rear 266 corners. The left side 242 is planar. Each hooked-rod receiver 246 and horizontal straight-rod-receiving hole 258 lay within the plane of the left side 242.

The bottom 270 has at least one cantilevered rod 274 extending forward and substantially perpendicular to its front edge 278. The bottom 270 has at least one cantilevered rod 282 extending backward and substantially perpendicular to its back edge 286. The bottom 270 is planar. Each cantilevered rod 274 and 282 lies within the plane of the bottom 270.

Each of the bottom's 270 forward extending cantilevered rods 274 are slideably connected into each straight-rod-receiving hole 154 located along the lower edge 158 of the front side 114. Likewise, each of the bottom's 270 backward extending cantilevered rods 282 are slideably connected into each straight-rod-receiving hole 206 located along the lower edge 210 of the back-side 162.

The hooked-rod 118 of the front side 114 is hook-ably connected to the hooked-rod receiver 218 of the right side 214. The hooked-rod 166 of the back-side 162 is hook-ably connected to the hooked-rod receiver 218 of the right side 214. The cantilevered horizontal straight-rod 138 of the front side 114 is slideably connected into the horizontal straight-rod-receiving hole 230 of the right side 214. The cantilevered straight-rod 186 of the back-side 162 is slideably connected into the horizontal straight-rod-receiving hole 230 of the right side 214.

The hooked-rod 118 of the front side 114 is hook-ably connected to the hooked-rod receiver 246 of the left side 242. The hooked-rod 166 of the back-side 162 is hook-ably connected to the hooked-rod receiver 246 of the left side 242. The horizontal cantilevered straight-rod 138 of the front side 114 is slideably connected into the horizontal straight-rod-receiving hole 230 of the left side 242. The cantilevered horizontal straight-rod 186 of the back-side 162 is slideably connected into the horizontal straight-rod-receiving hole 258 of the left side 242.

Each rod 38 is slideably connected into the rod-receiving hole 150 of the front side 114 and the rod-receiving hole 198 of the back-side 162.

In still another variation of this invention, a lid 290 is interlocked by a hinge means 294 to the upper edge 202 of the back-side 162. The hinge means 294 comprises a pair of outwardly cantilevered, hooked-rods 294. The hooked-rods 294 are aligned in opposite directions towards each other on the lower edge 306 of the lid 290. The lid 290 and the hooked-rods 298 are coplanar. A pair of hooked-rod, receiving tubes 302 are horizontally located on the upper edge 202 of the back-side 162. The hooked-rods 298 are slideably connected into the hooked-rod-receiving tubes 302.

In yet another variant of this invention, the right side 214, the left side 242, the front side 114, the back-side 162 and the bottom 270 are fabricated from metal wire, whicker stretched over a metal wire frame, plastic, wood with plastic cantilevered rods or wood with metal cantilevered rods.

Another variant of this invention, shown in FIGS. 10 through 13, is used to construct a portable fireplace 410. The four sides are interlocked together by a first frame 414 and a second frame 418. The four include a first side 422, a second side 426, a third side 430 and a fourth side 434. Each side has a first substantially vertical edge 442 and a second substantially vertical edge 442. The size and shape of the first frame 414 and the second frame 418 facilitates its removeable interlocking with each adjacent side and removeable interlocking to the bottom 446.

The first frame 414 has a first substantially vertical support 454 linked by at least one cross member to a second substantially vertical support 458. The second frame 418 has a first substantially vertical support 462 linked by at least one cross member 466 to a second substantially vertical support 470. Each substantially vertical support 454, 458, 462 and 470 has a first end 474, a second end 478, a front face 482, a back face 486 and an inner face 490.

The bottom 446 includes a plate 494 removeably interlocked to a base 498. The plate 494 serves as an ash and flame shield. The first frame 414 and the second frame 418 are removeably interlocked into the plate 494. The base 498 has a plurality of legs 502.

The second side 426 and the fourth side 434 each have a first 506 and a second horizontal, coplanar rod 510 cantilevered outward from each substantially vertical edge 438 and 442. The first frame 414 and the second frame 418 have a pair of horizontal rod-receiving holes 514 on the back face 486 of each substantially vertical support 454 and 458. Each horizontal rod-receiving hole 514 is substantially perpendicular to the plane of each frame 414 and 418. The second side 426 is interlocked to the first substantially vertical support 454 and 462 of the first frame 414 and the second frame 418 so that each first 506 and second horizontal coplanar rod 510 is installed into the corresponding pair of horizontal rod-receiving holes 514 in each first substantially vertical support 454 and 462. The fourth side 434 is interlocked to the second substantially vertical support 458 and 470 of the first frame 414 and the second frame 418 so that each first 506 and second horizontal coplanar rod 510 is installed into the corresponding pair of horizontal rod-receiving holes 514 in each second substantially vertical support 458 and 470.

A grill 518 is placed upon the plate 494. The first end 474 of each substantially vertical support 454, 458, 462 and 470 has a flap 522. The plate 494 has four slots 526 sized, shaped and located to slideably receive the flap 522 of each substantially vertical support 454, 458, 462 and 470.

Figure 10:
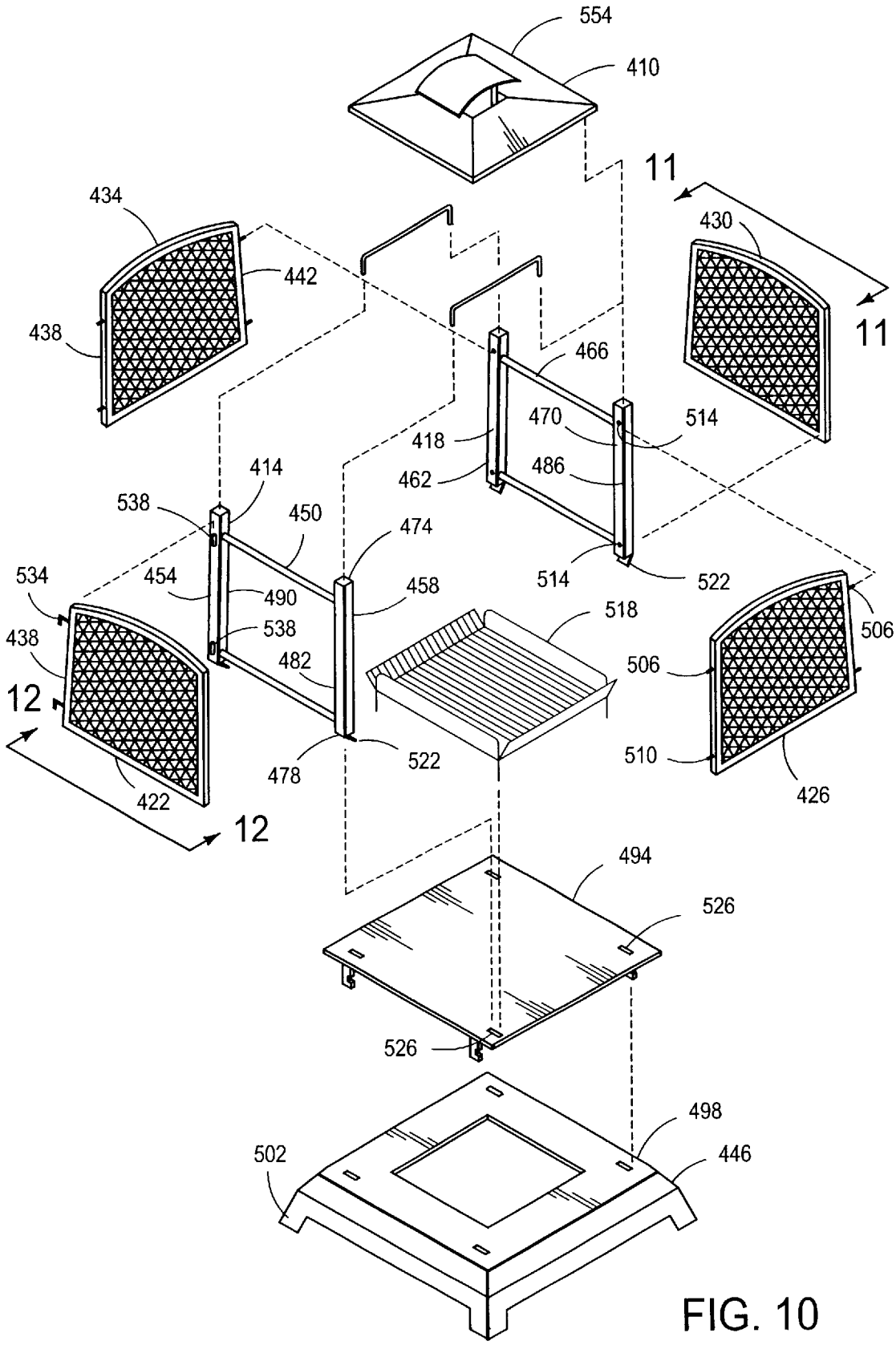
FIG. 10 is an exploded perspective view of the portable fireplace.
Figure 11:
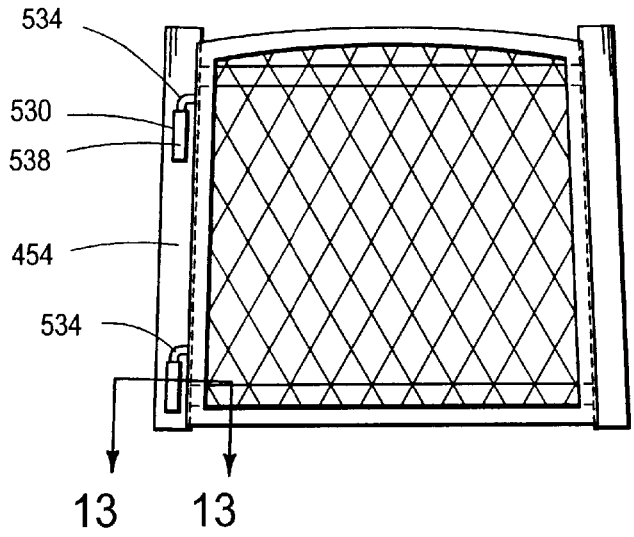
FIG. 11 is a view showing the fireplace door installation.
Figure 13:
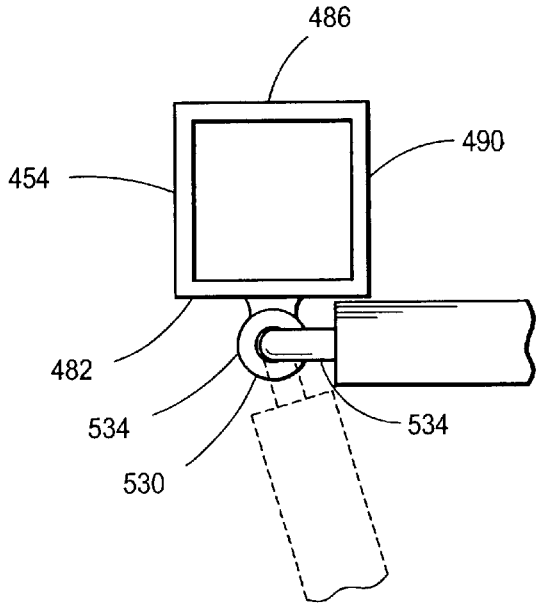
FIG. 13 is a top view of the fireplace door hinge.

The first side 422, as shown in FIGS. 10, 11 and 13, is releasably interlocking into the first frame 414 by a hinge means 530. The hinge means 530 comprises a pair of outwardly cantilevered, hooked-rods 534 extending downwards from the first substantially vertical edge 438 of the first side 422 and a pair of hooked rod-receiving tubes 538 vertically located on the front face 482 of the first substantially vertical support 454 of the first frame 414.

Figure 12:
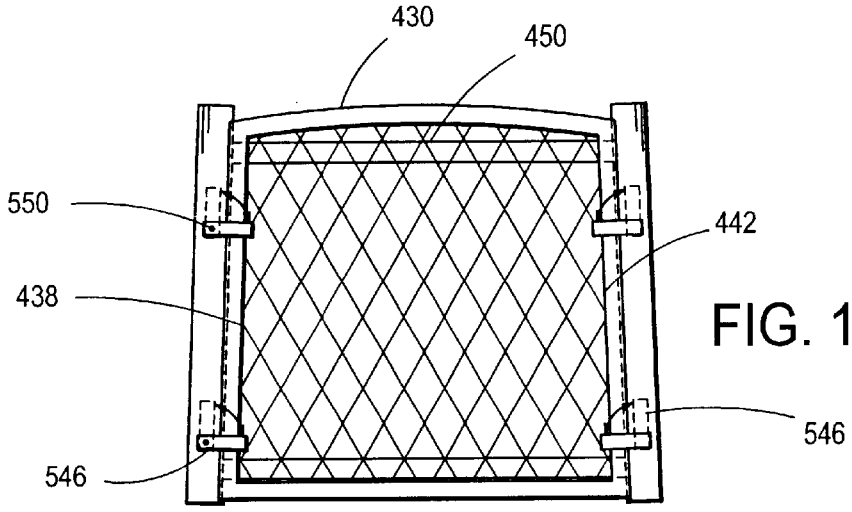
FIG. 12 is a view showing the fireplace screen retained by the pivoting locking plate.

As shown in FIG. 12, the second frame 418 has a means for releasably interlocking with the third side 430. Each substantially vertical support 454, 458, 462 and 470 has at least one pivoting locking plate 546. The pivoting locking plate 546 pivots on a rotation point 550. The third side 430 is retained when the first substantially vertical edge 438 is located against a cross member 450 and the second substantially vertical edge 438 is located against a cross member 450 and each locking plate 546 is pivoted into a horizontal position.

A fireplace lid, shown in FIG. 10, is installed by interlocking it with the second end 478 of each substantially vertical support 454, 458, 462 and 470.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not only by the embodiments illustrated, but by the appended claims and their legal equivalents.

What is claimed is:

1. An interlocking structure comprising:

at least one rod, the at least one said rod having a U-shape with a first end and a second end;

at least four sides and a bottom, each said side having four edges, said bottom having four edges, removeably interlocking said edge of each said side to the adjacent said edge of the adjacent said side to connect said four sides together, removeably interlocking said bottom side to at least two of the interlocked said sides;

a said side and the opposite said side each having at least one rod receptacle;

the interlocking structure of four said sides and said bottom being held together by the removeable installation of the first end of the at least one said rod into said rod receptacle on a said side and the second end of said rod into a rod receptacle on the opposite said side.

2. An interlocking structure according to claim 1 wherein the four said sides comprising a right side, a left side, a front side and a back-side.

3. An interlocking structure according to claim 2 wherein said right side having a cantilevered, upwardly hooked-rod extending outward from its lower front and lower rear corners, said hooked-rod having a horizontal section supporting a vertical section, said right side having a horizontal straight rod-receiving hole in its upper front and upper rear corners, said right side being planar;

said left side having a cantilevered, upwardly hooked-rod extending outward from its lower front and lower rear corners, said hooked-rod having a horizontal section supporting a vertical section, said left side having a horizontal straight-rod-receiving hole in its upper front and upper rear corners, said left side being planar;

said front side having a cantilevered horizontal straight-rod extending from its upper right and upper left corners, said front side being planar, each said straight-rod extending substantially perpendicular to the plane of said front side, said front side having at least one rod-receiving hole located along its upper edge, each said rod-receiving hole being vertically aligned and coplanar to said front side, said front side having at least one straight-rod-receiving hole located along its lower edge, each straight-rod-receiving hole being normal to the plane of said front side, said front side having a hooked-rod receiver vertically aligned in its lower right and lower left corners, said hooked-rod receiver having a rounded notch edge to accept the horizontal portion of said hooked-rod;

said back-side having a cantilevered horizontal straight-rod extending from its upper right and upper left corners, said back-side being planar, each said straight-rod extending substantially perpendicular to the plane of said back-side, said back-side having at least one rod-receiving hole located along its upper edge, each said rod-receiving hole being vertically aligned and coplanar to said back-side, said back-side having at least one straight-rod-receiving hole located along its lower edge, each straight-rod-receiving hole being normal to the plane of said back-side, said back-side having a hooked-rod receiver vertically aligned in its lower right and lower left corners, said hooked-rod receiver having a rounded notch edge to accept the horizontal portion of said hooked-rod;

said bottom having at least one cantilevered rod extending forward and substantially perpendicular to its front edge, said bottom having at least one cantilevered rod extending backward and substantially perpendicular to its back edge, said bottom being planar, each said cantilevered rod laying within the plane of said bottom;

said bottom's forward extending at least one cantilevered said rod being slideably connected into said at least one straight-rod-receiving hole located along the lower edge of said front side, said bottom's backward extending said at least one cantilevered rod being slideably connected into said at least one straight-rod-receiving hole located along the lower edge of said back-side;

said hooked-rod of said right side being hook-ably connected to said hooked-rod receiver of said front side, said hooked-rod of said right side being hook-ably connected to said hooked-rod receiver of said back-side, said cantilevered straight-rod of said front side being slideably connected into said straight-rod-receiving hole of said right side, said cantilevered straight-rod of said back-side being slideably connected into said straight-rod-receiving hole of said right side;

said hooked-rod of said left side being hook-ably connected to said hooked-rod receiver of said front side, said hooked-rod of said left side being hook-ably connected to said hooked-rod receiver of said back-side, said cantilevered straight-rod of said front side being slideably connected into said straight-rod-receiving hole of said left side, said cantilevered straight-rod of said back-side being slideably connected into said straight-rod-receiving hole of said left side; and said rod being slideably connected into said rod-receiving hole of said front side and said rod-receiving hole of said back-side.

4. An interlocking structure according to claim 3 wherein said right side, said left side, said front side, said back-side and said bottom being fabricated from materials being selecting from the group consisting of metal wire, whicker stretched over a metal wire frame, plastic, wood with plastic or metal connector rods and plastic or metal rod receivers.

5. An interlocking structure according to claim 3 further comprises a lid interlocked by a hinge means to a top edge of said back-side, said hinge means comprises a pair of outwardly cantilevered, hooked-rods, said hooked-rods being aligned in opposite directions towards each other, said lid and said hooked-rods being coplanar, a pair of hooked rod-receiving tubes horizontally located on top edge of said back-side, said hooked-rods being slideably connected into said hooked-rod-receiving tubes.

6. An interlocking structure according to claim 2 wherein said front side having a cantilevered, upwardly hooked-rod extending substantially perpendicularly rearward from its lower right and lower left corners, said hooked-rod having a horizontal section supporting a vertical section, said front side having a cantilevered, horizontal straight-rod extending substantially perpendicularly rearward from its upper right and upper left corners, except for said hooked-rod and said horizontal straight-rods, said front side having at least one rod-receiving hole located along its upper edge, each said rod-receiving hole being vertically aligned and coplanar to said front side, said front side having at least one straight-rod-receiving hole located along its lower edge, each said straight-rod-receiving hole being normal to the plane of said front side, said front side being planar;

said back-side having a cantilevered, upwardly hooked-rod extending substantially perpendicularly forward from its lower right and lower left corners, said hooked-rod having a horizontal section supporting a vertical section, said back-side having a cantilevered horizontal straight-rod extending substantially perpendicularly forward from its upper right and upper left corners, except for said hooked-rod and said horizontal straight-rods, said back-side having at least one rod-receiving hole located along its upper edge, each said rod-receiving hole being vertically aligned and coplanar to said back-side, said back-side having at least one straight-rod-receiving hole located along its lower edge, each said, straight-rod-receiving hole being normal to the plane of said back-side, said back-side being planar;

said right side having a hooked-rod receiver vertically aligned in its lower front and lower rear corners, said hooked-rod receiver having a rounded notch edge to accept the horizontal portion of said hooked-rod, said right side having a horizontal straight-rod-receiving hole in its upper front and upper rear corners, said right side being planar, each said hooked-rod receiver and horizontal straight-rod-receiving hole lay within the plane of said right side;

said left side having a hooked-rod receiver vertically aligned in its lower front and lower rear corners, said hooked-rod receiver having a rounded notch edge to accept the horizontal portion of said hooked-rod, said left side having a horizontal straight-rod-receiving hole in its upper front and upper rear corners, said left side being planar, each said hooked-rod receiver and horizontal straight-rod-receiving hole lay within the plane of said left side;

said bottom having at least one cantilevered rod extending forward and substantially perpendicular to its front edge, said bottom having at least one cantilevered rod extending backward and substantially perpendicular to its back edge, said bottom being planar, each said cantilevered rod laying within the plane of said bottom;

said bottom's forward extending at least one said cantilevered rod being slideably connected into the at least one said straight-rod-receiving hole located along the lower edge of said front side, said bottom's backward extending the at least one said cantilevered rod being slideably connected into the at least one said straight-rod-receiving hole located along the lower edge of said back-side;

said hooked-rod of said front side being hook-ably connected to said hooked-rod receiver of said right side, said hooked-rod of said back-side being hook-ably connected to said hooked-rod receiver of said right side, the cantilevered, horizontal said straight-rod of said front side being slideably connected into the horizontal said straight-rod-receiving hole of said right side, the cantilevered, horizontal said straight-rod of said back-side being slideably connected into the horizontal said straight-rod-receiving hole of said right side;

said hooked-rod of said front side being hook-ably connected to said hooked-rod receiver of said left side, said hooked-rod of said back-side being hook-ably connected to said hooked-rod receiver of said left side, the cantilevered, horizontal said straight-rod of said front side being slideably connected into the cantilevered, horizontal said straight-rod-receiving hole of said left side, the cantilevered, horizontal said straight-rod of said back-side being slideably connected into said straight-rod-receiving hole of said left side; and each said rod being slideably connected into said rod-receiving hole of said front side and said rod-receiving hole of said back-side.

7. An interlocking structure according to claim 6 wherein said right side, said left side, said front side, said back-side and said bottom being fabricated from materials being selecting from the group consisting of metal wire, whicker stretched over a metal wire frame, plastic, wood with plastic or metal connector rods and plastic or metal rod receivers.

8. An interlocking structure according to claim 6 further comprises a lid interlocked by a hinge means to the upper edge of said back-side, said hinge means comprises a pair of outwardly cantilevered, hooked-rods, said hooked-rods being aligned in opposite directions towards each other on the lower edge of said lid, said lid and said hooked-rods being coplanar, a pair of hooked rod-receiving tubes horizontally located on upper edge of said back-side, said hooked-rods being slideably connected into said hooked-rod-receiving tubes.

9. An interlocking structure according to claim 1 wherein the four said sides being interlocked together by a first frame and a second frame, the four said sides comprising a first side, a second side, a third side and a fourth side, each said side having a first substantially vertical edge and a second substantially vertical edge, the size and shape of said first frame and said second frame facilitates its removeable interlocking with each adjacent said side and removeable interlocking to said bottom.

10. An interlocking structure according to claim 9 wherein said first frame having a first substantially vertical support linked by at least one cross member to a second substantially vertical support, said second frame having a first substantially vertical support linked by at least one cross member to a second substantially vertical support, each said substantially vertical support having a first end, a second end, a front face, a back face and an inner face.

11. An interlocking structure according to claim 9 wherein said bottom comprising a plate removeably interlocked to a base, said first frame and said second frame being removeably interlocked into said plate.

12. An interlocking structure according to claim 10 said second side and said fourth side each having a first and a second horizontal coplanar rod cantilevered outward from each said substantially vertical edge, said first frame and said second frame having a pair of horizontal rod-receiving holes on said back face of each substantially vertical support, each said horizontal rod-receiving hole being substantially perpendicular to the plane of each said frame, said second side being interlocked to said first substantially vertical support of said first frame and said second frame so that each said first and said second horizontal coplanar rod being installed into the corresponding pair of said horizontal rod-receiving holes in each said first substantially vertical support, said fourth side being interlocked to said second substantially vertical support of said first frame and said second frame so that each said first and said second horizontal coplanar rod being installed into the corresponding pair of said horizontal rod-receiving holes in each said second substantially vertical support.

13. An interlocking structure according to claim 11 wherein a grill being placed upon said plate, said first end of each said substantially vertical support having a flap, said plate having four slots sized, shaped and located to slideably receive the said flap of each said substantially vertical support.

14. An interlocking structure according to claim 10 wherein a said side being releasably interlocking to said first frame by a hinge means.

15. An interlocking structure according to claim 14 wherein said hinge means comprises a pair of outwardly cantilevered, hooked-rods extending downwards from said first substantially vertical edge of said first side and a pair of hooked rod-receiving tubes vertically located on said front face of said substantially vertical support, said hooked-rods being slideably connected into said hooked-rod-receiving tubes.

16. An interlocking structure according to claim 10 wherein said second frame having a means for releasably interlocking with a said third side.

17. An interlocking structure according to claim 16 wherein said means for releasably interlocking comprises each said substantially vertical support having at least one pivoting locking plate, said locking plate revolves on a rotation point, said third side being retained when said first substantially vertical edge being located against a said cross member and said second substantially vertical edge being located against a said cross member and each said locking plate pivoted into a horizontal position.

18. An interlocking structure according to claim 11 wherein said base having a plurality of legs.

19. An interlocking structure according to claim 11 further comprising a lid, said lid interlocking with said second end of each said substantially vertical support.

* * * * *